US006312073B1

(12) United States Patent
Inora et al.

(10) Patent No.: US 6,312,073 B1
(45) Date of Patent: Nov. 6, 2001

(54) SYSTEM FOR DETECTING AN ACCURATE AMOUNT OF INK CONSUMPTION IN AN INK JET RECORDING DEVICE

(75) Inventors: Masaru Inora; Hideyuki Kobayashi, both of Niigata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 08/986,749

(22) Filed: Dec. 8, 1997

(30) Foreign Application Priority Data

Sep. 12, 1996 (JP) ..... 8-327408

(51) Int. Cl.[7] ..... B41J 2/195; B41J 29/393
(52) U.S. Cl. ..... 347/7; 347/19
(58) Field of Search ..... 347/7, 19, 22, 347/23, 30, 35

(56) References Cited

U.S. PATENT DOCUMENTS 5,414,452 * 5/1995 Accatino et al. ..... 347/7
5,610,635 * 3/1997 Murray et al. ..... 347/7
5,894,313 * 4/1999 Mabuchi ..... 347/7
5,900,888 * 5/1999 Kurosawa ..... 347/7
6,145,947 * 11/2000 Inora et al. ..... 347/7

FOREIGN PATENT DOCUMENTS 3193359 8/1991 (JP) .
3-246058 11/1991 (JP) .
3246058 11/1991 (JP) .
6210934 8/1994 (JP) .
8224891 9/1996 (JP) .
9-156123 6/1997 (JP) .

* cited by examiner

*Primary Examiner*—John Barlow
*Assistant Examiner*—Juanita Stephens
(74) *Attorney, Agent, or Firm*—Sughrue, Mion, Zinn, Macpeak & Seas, PLLC

(57) ABSTRACT

A system for detecting an ink consumption in an ink jet recording device comprises a non-volatile memory for storing an accumulated amount of ink consumption, update section for incrementing the stored amount by a new amount of ink consumption, a comparator for comparing the accumulated amount against a variable reference amount, and a display section for displaying the accumulated amount of ink consumption or a residual amount of ink in the ink jet recording device. The recorded amount includes total ink consumption by nozzle cleaning, nozzle suction and ink discharge.

16 Claims, 8 Drawing Sheets

SYSTEM FOR DETECTING AN ACCURATE AMOUNT OF INK CONSUMPTION IN AN INK JET RECORDING DEVICE

BACKGROUND OF THE INVENTION (a) Field of the Invention

The present invention relates to a system for detecting an amount of ink consumption or a recorded amount in an ink jet recording device, such as an ink jet printer.

(b) Description of the Related Art

A system for detecting a recorded amount or amount of ink consumption in an ink jet recording device is described in Patent Publication JP-A-3 (1991)-246058, for example. Briefly, the system includes a page counter for storing an amount of ink consumption which is converted from an amount of recorded data, an increment section for sequentially updating the page counter if there is an ink consumption resulting from data recording, and an alarm signal generator for generating an alarm when the residual amount of ink is considered below a threshold based on the initial amount of the ink and the accumulated ink consumption.

Specifically, when a new ink reservoir is placed in the ink jet printer, a signal indicating the replacement of the ink reservoir is supplied to a controller in the ink jet printer to clear the page counter. If a print command signal is received in the ink jet printer, the printer effects a recording operation by ejecting ink supplied from the ink reservoir. When an amount of data corresponding to one page is recorded by the printer, the increment section increments the count of the page counter by one page.

In this manner, the page counter is updated at each time the recording operation for one page is completed. If the amount of ink corresponding to the volume in the ink reservoir is counted in the page counter, the controller determines that recording operation for a specified number of pages has been completed, displays an alarm signal that the ink reservoir is empty or close to empty and stops further recording operation. A non-volatile memory is used for the page counter, thereby allowing the count representing the ink consumption or residual amount of the ink to be maintained without a power supply to the printer.

In the conventional ink jet printer, a user for a computer system including the ink jet printer knows the emptying of the ink reservoir only when the printing is stopped or interrupted by the alarm from the printer, which causes the computer work done by the user to be inconvenienced.

SUMMARY OF THE INVENTION

It is therefore an object of the present invention to provide an improved ink jet recording device capable of informing a more accurate residual amount of ink and allowing a more convenient use, wherein a sudden interruption of the recording operation is prevented.

In accordance with the present invention, there is provided a system for detecting an amount of ink consumption in an ink jet recording device. The system comprises a storage section for storing an accumulated recorded amount corresponding to an ink consumption, an update section for incrementing the accumulated recorded amount by a new recorded amount corresponding to a new ink consumption, a comparator for comparing the accumulated recorded amount read from the storage section against a threshold amount to output a recorded amount signal, and a display section for displaying the recorded amount signal.

With a system for detecting an amount of ink consumption in an ink jet recording device according to a preferred embodiment of the present invention, the amount of ink consumption is determined on the basis of the numbers of times of operations by which a recording nozzle is subject to a cleaning operation, an ink suction operation and an ink discharge operation. The host computer requests the data for transfer of the recorded amount, and compares the transferred recorded amount against a variable threshold and display the result of the comparison on a screen.

In accordance with the system according to the present invention, an accurate recorded amount can be obtained and informed to the user, which enables an efficient computer working.

The above and other objects, features and advantages of the present invention will be more apparent from the following description, referring to the accompanying drawings.

DESCRIPTION OF THE PREFERRED EMBODIMENTS

Figure 1:
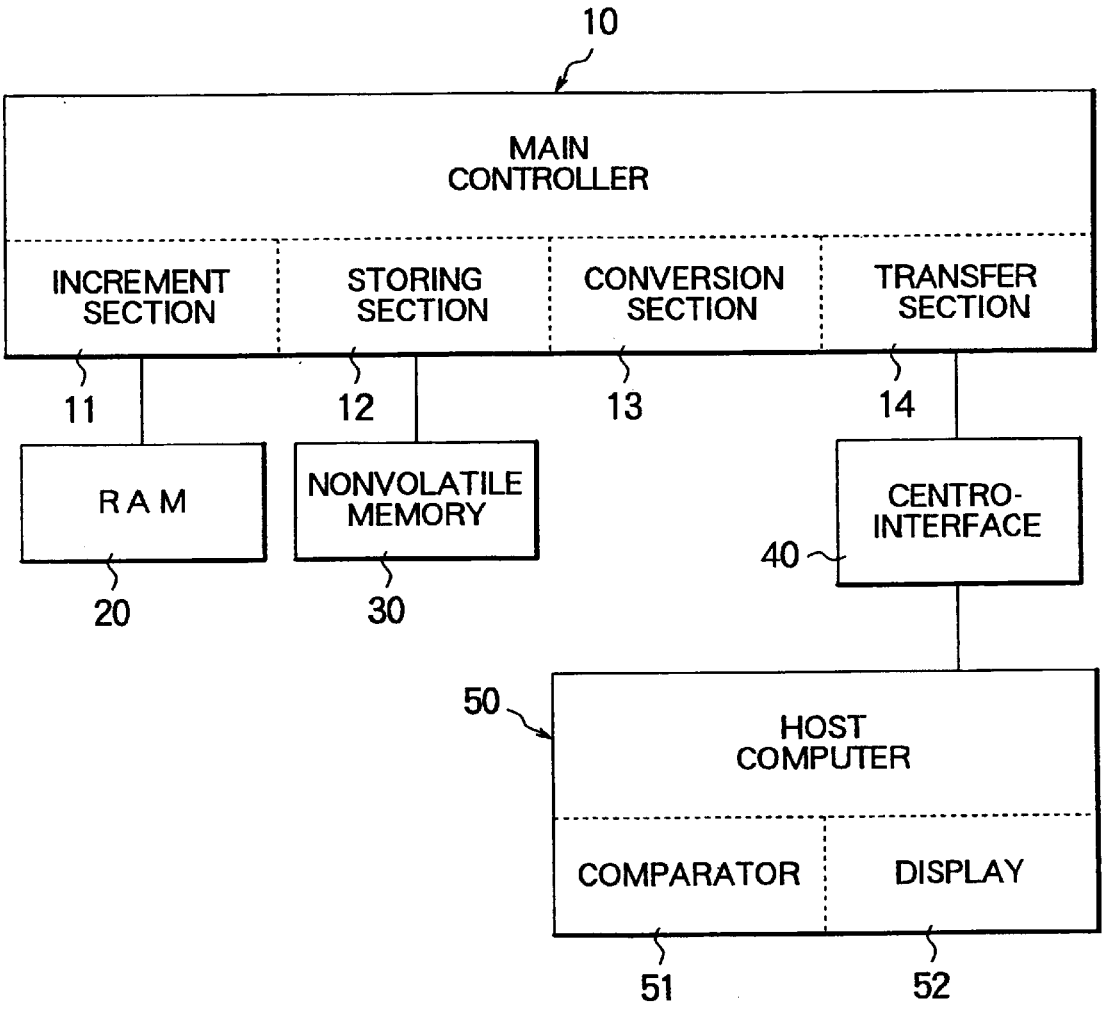
FIG. 1 is a block diagram of a system for detecting amount of ink consumption in an ink jet recording device according to a first embodiment of the present invention.

Now, the present invention is more specifically described with reference to accompanying drawings, wherein similar constituent elements are designated by the same or similar reference numerals.

Referring first to FIG. 1 showing a system for detecting the amount of ink consumption or the recorded amount in an ink jet printer, which is an example of an ink jet recording device according to a first embodiment of the present invention, the system comprises a main controller 10, a random access memory (RAM) 20 used as a temporary storage, a non-volatile memory 30 capable of maintaining data relating to the amount of ink consumption after the power supply to the printer is turned off, a bilateral Centro-interface 40 for transferring information between the main controller 10 and a host computer 50, on which a host program runs for calculating the amount of ink consumption.

The term "amount of the recorded data or recorded amount" as used herein is equivalent to the amount of ink which is consumed by cleaning of ink nozzle, suction of ink at nozzle, and discharge of ink from the ink nozzle to a recording sheet in the ink jet recording head, wherein the latter is significantly small as compared to the other two operations. The amount of the recorded data may be represented by a compliment of the residual amount of the ink in the ink reservoir.

The main controller 10 in the ink jet printer comprises a plurality of functional sections including a recorded amount update section (or an increment section) 11, a recorded amount storage section 12, a recorded amount conversion section 13 and a recorded amount transfer section 14. The increment section 11 is capable of counting the recorded amount by counting the number of times for either one of the three operations consuming the ink. The recorded amount storing section 12 stores the recorded amount counted by the increment section 11. The recorded amount conversion section 13 converts the numbers of respective operations stored in the storing section into the recorded amounts or the amounts of the ink which is consumed by the numbers of respective operations, thereby representing the respective recorded amounts in a unified term. The recorded amount transfer section 14 functions for transferring the sum of the recorded amounts from the conversion section 13 to the host computer 50.

The host computer 50 on which the host program runs comprises a decision section (or coaparator) 51 and a display section 52. The comparator 51 determines by comparison whether or not the total recorded amount transferred from the recorded amount transfer section 14 has exceeded a given threshold.

The decision by the comparator may be based on the ink consumption itself, or the residual amount of ink in the ink reservoir. Further, the decision may be based on a number times of ink discharge operations including the ink consumption effected by the other operations in terms of the ink discharge operation.

The display section 52 displays the result of decision by the comparator 51. The result may be displayed in terms of the ink consumption, the residual amount of ink or a number of ink discharge operations depending on the term used in the decision section 51.

Figure 2:
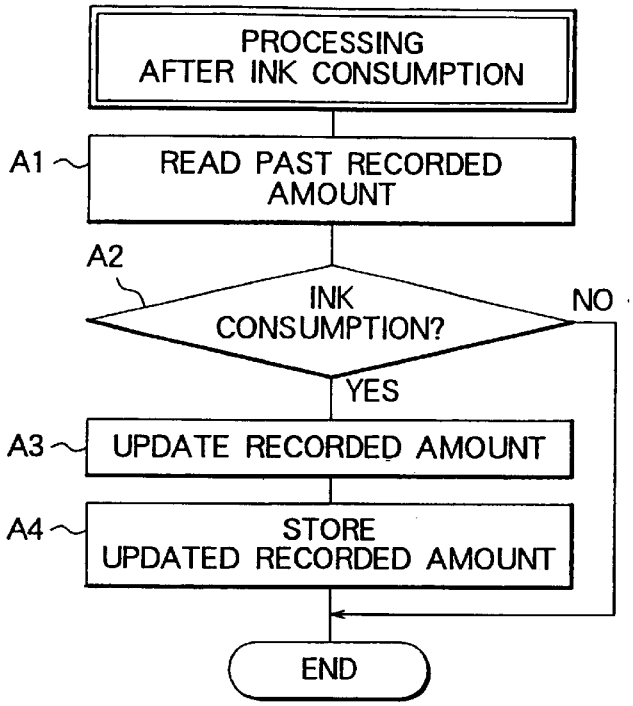
FIGS. 2 to 9 are flowcharts each showing the steps of operation of the system of FIG. 1.

Referring to FIG. 2, there is shown the steps of processing by the main controller 10 after an ink consumption in the first embodiment. A flag has been set in the RAM 20 during the ink consumption, and the accumulated recorded amount in the past is stored in the non-volatile memory 30. First, a recorded amount in the past is read out from the non-volatile memory 30 at step A1. It is determined whether or not the ink consumption has took place based on the flag in the RAM 20 at step A2. If there was no ink consumption, the process comes to an end. If the ink consumption has taken place, the recorded amount update section 11 updates the recorded amount at step A3. The recorded amount storing section 12 stores the updated recorded amount into the non-volatile memory 30 at step A4.

Figure 3:
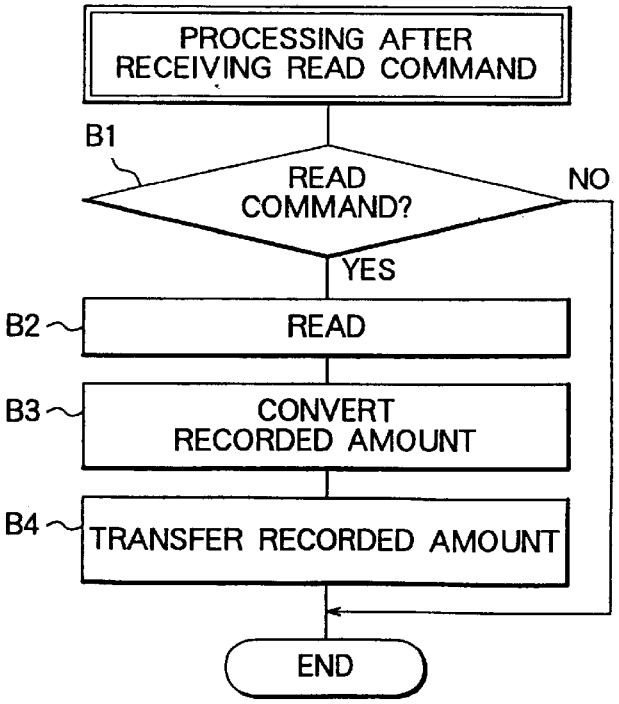

Referring to FIG. 3, there is shown the steps of processing by the main controller 10 for receiving and processing a command from the host computer 50. At step B1, it is determined whether or not a command received from the host computer 50 indicates a read command for the recorded amount. If it is not a read command, the process comes to an end. If it is detected at step B1 that the command is a read command, the numbers of times in respective operations are read out from the non-volatile memory 30 at step B2, then converted into equivalent amounts of ink or recorded amounts and added together at step B3, and the resultant total amount of ink consumption is transferred to the host computer 50 at step B4 to inform the recorded amount to the host computer.

Figure 4:
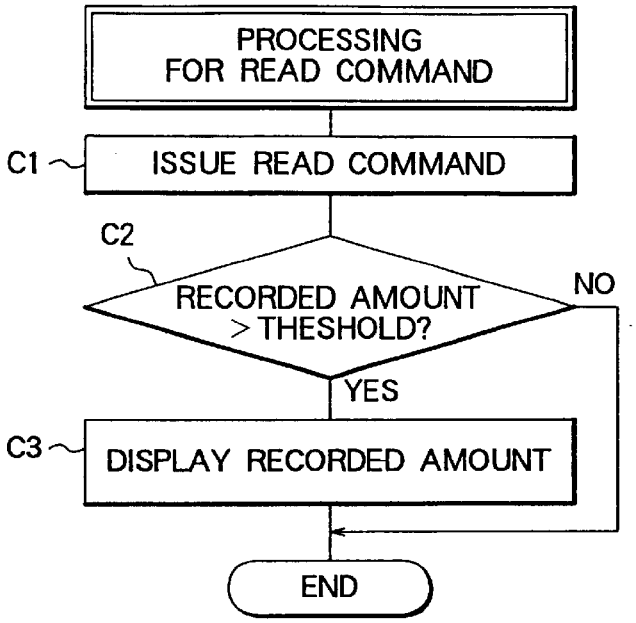

Referring to FIG. 4, there is shown the steps of processing in the host computer 50, wherein a read command to read a recorded amount is issued at step C1. The host computer 50, after receiving the total recorded amount through the bilateral Centro-interface 40, compares in the decision section 51 the total recorded amount against a variable threshold at step C2 and allows the display section 52 to display the result of the comparison at step C3.

Figure 5:
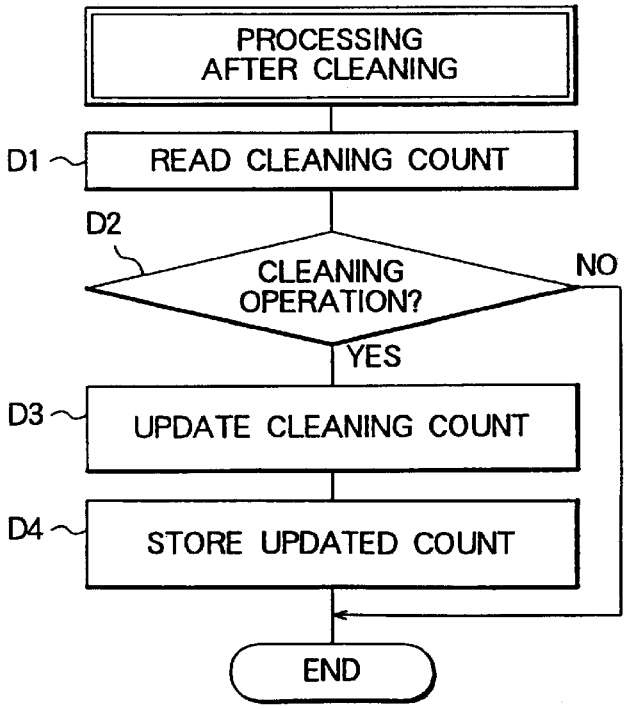

Referring to FIG. 5 there is shown the steps of processing after a cleaning operation which consumes ink in the ink chamber of the recording head. First, the main controller 10 reads a stored cleaning count from the non-volatile memory 30 at step D1. A cleaning flag has been set in the RAM 20 during the cleaning operation in the recording head. It is determined whether or not a cleaning operation has taken place based on the cleaning flag at step D2. If there was no cleaning operation, the process comes to an end. On the other hand, if it is determined that a cleaning operation has taken place at step D2, the recorded amount update section 11 updates the cleaning count at step D3. The recorded amount storing section 12 then stores the updated cleaning count in the non-volatile memory 30 at step D4.

Figure 6:
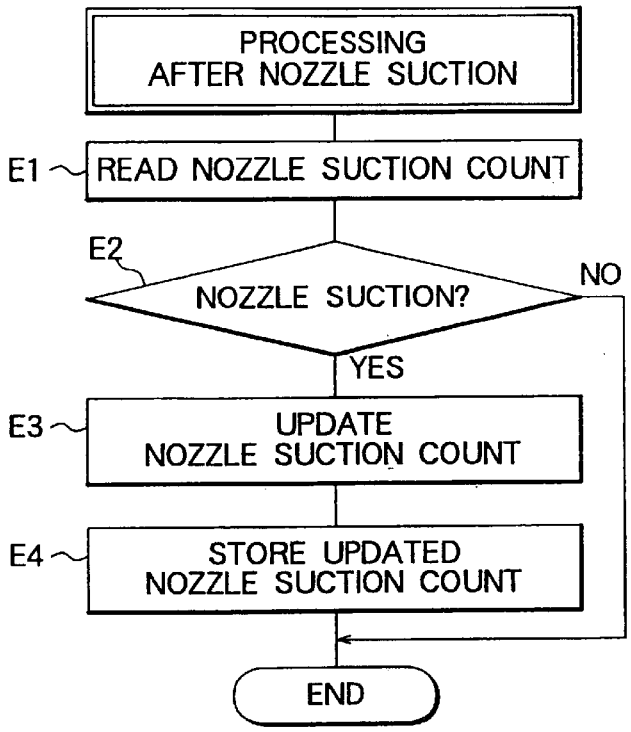

Referring to FIG. 6, there is shown the steps of processing after an ink suction by the nozzle which also consumes ink in the ink chamber. The main controller 10 reads a nozzle suction count from the non-volatile memory 30 at step E1. A suction flag has been set in RAM 20 during the nozzle suction operation. It is determined whether the nozzle suction has taken place in the recording head based on the suction flag at step E2. If the nozzle suction has not taken place, the process comes to an end. On the other hand, if the nozzle suction has taken place, the recorded amount update section 11 updates the nozzle suction count at step E3, and the recorded amount storing section 12 stores the updated nozzle count into the non-volatile memory at step E4.

Figure 7:
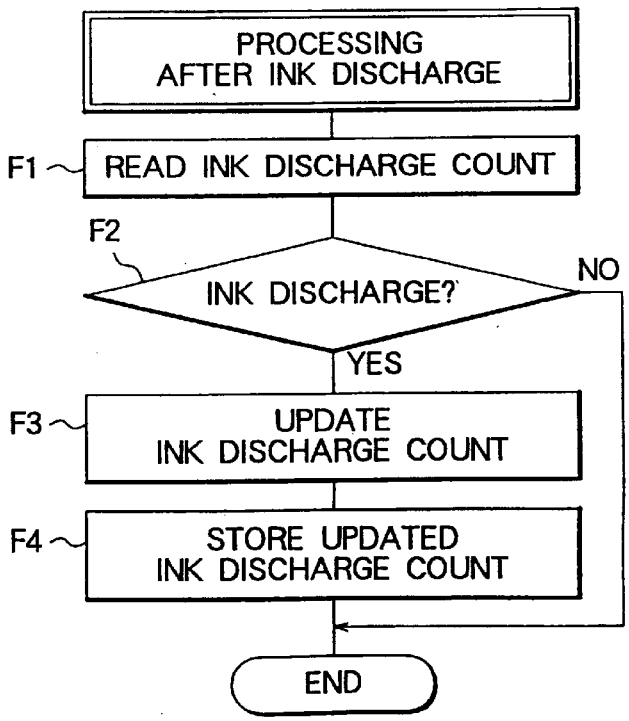

Referring to FIG. 7, there is shown the steps of the processing after a printing operation or ink discaarge by the recording head. The main controller 10 reads out the ink discharge count from the non-volatile memory 30 at step F1. A a print flag has been set in the RAM 20 during the ink discharge operation. It is determined whether or not the ink discharge operation has taken place based on the print flag at step F2. If no ink discharge operation has taken place, the process comes to an end. On the other hand, if an ink discharge operation has took place, the recorded amount update section 11 updates the ink discharge count at step F3. The recorded amount storing section 12 stores the updated ink discharge count into the non-volatile memory 30 at step F4.

Figure 8:
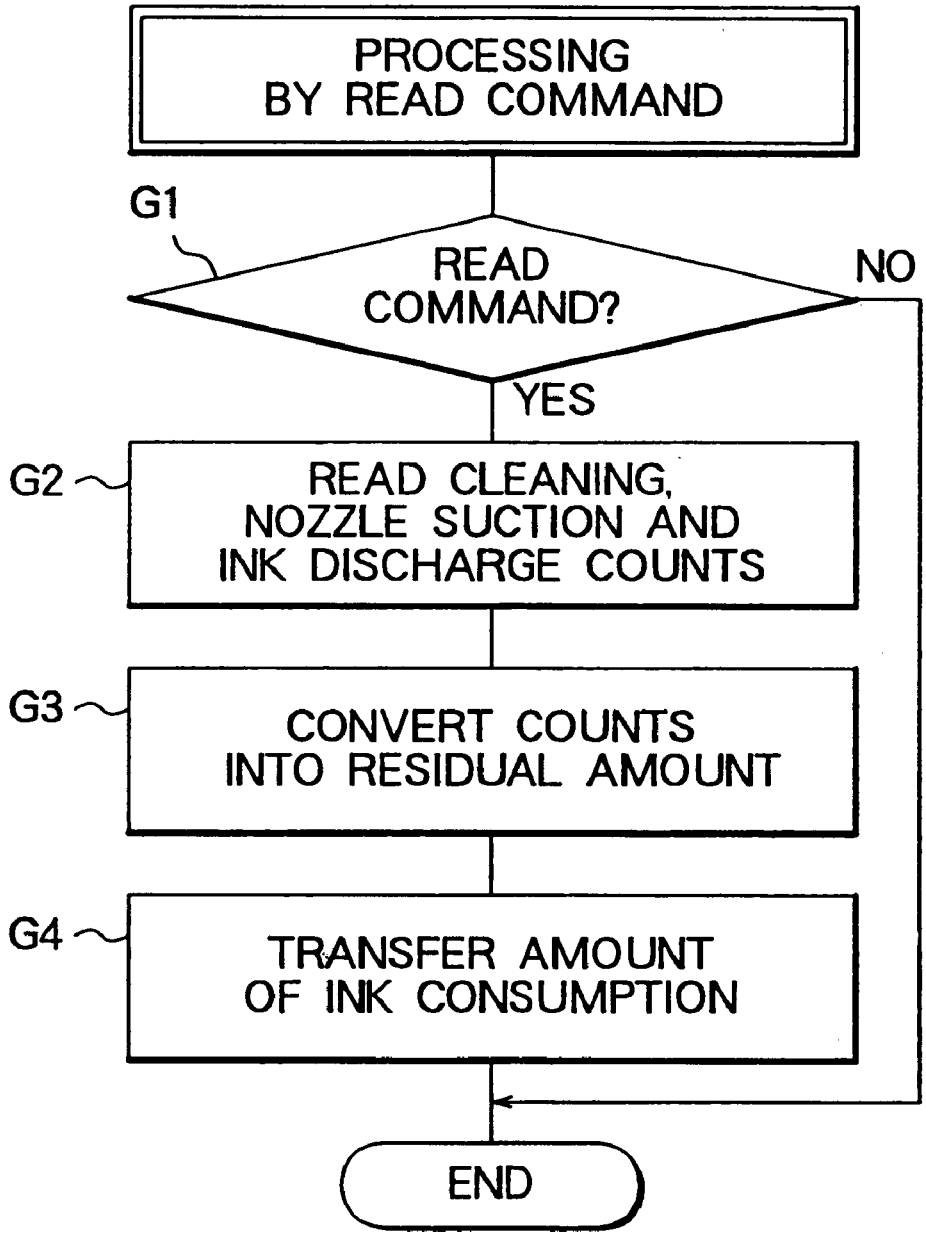

Referring to FIG. 8, there is shown the steps of processing in the main controller 10 for receiving a read command from the host computer 50. It is determined whether or not a command received from the host computer 50 is a read command for a recorded amount at step G1. If the command is not a read command for the recorded amount, the process comes to an end. On the other hand, if it is determined that the command is a read command for the recorded amount, the cleaning count, the nozzle suction count and the ink discharge count are read from the non-volatile memory 30 at step 12, converted into corresponding amounts of ink consumption and then into a residual amount of ink at step G3, and transferred to the host computer 50 at step G4.

Figure 9:
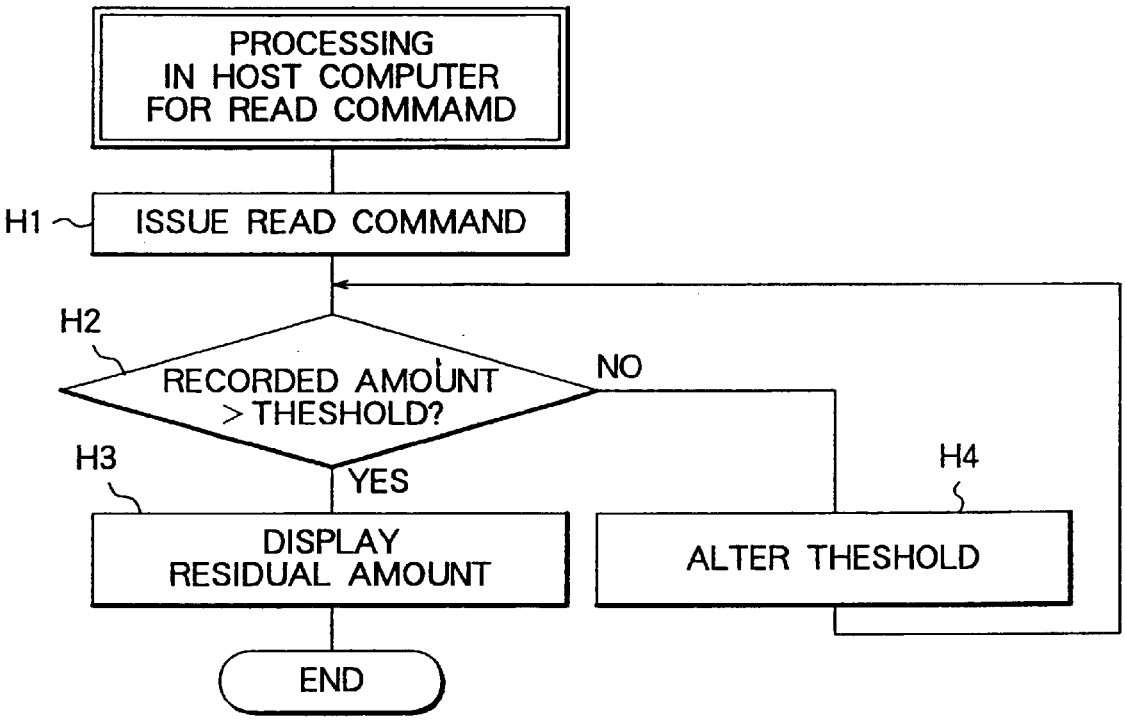

Referring to FIG. 9, there is shown the steps of processing in the host computer 50 for a read command for the residual amount of ink. The host computer 50 issues a command at step H1 to read out a residual amount of ink in the main controller 10. The host computer 50, after receiving the residual amount of ink, compares the residual amount against a given amount of ink at step H2. If the residual amount is higher than the given amount, the given amount is displayed as the residual amount of the ink at step H3. If the residual amount is less than the given amount, the given amount is lowered at step H4 by a unit scale for the display. The residual amount is also compared against the altered given amount at step H2, which step is continued until the residual amount becomes higher than the given amount, thereby finally displaying the residual amount of ink on the display 52.

In the manner as described above, the amounts of ink consumption in respective operations are counted and added together to obtain an accurate ink consumption or accurate residual amount of ink. Further, since the residual amount of ink can be displayed on a display by the host computer, an efficient computer working can be obtained.

Figure 10:
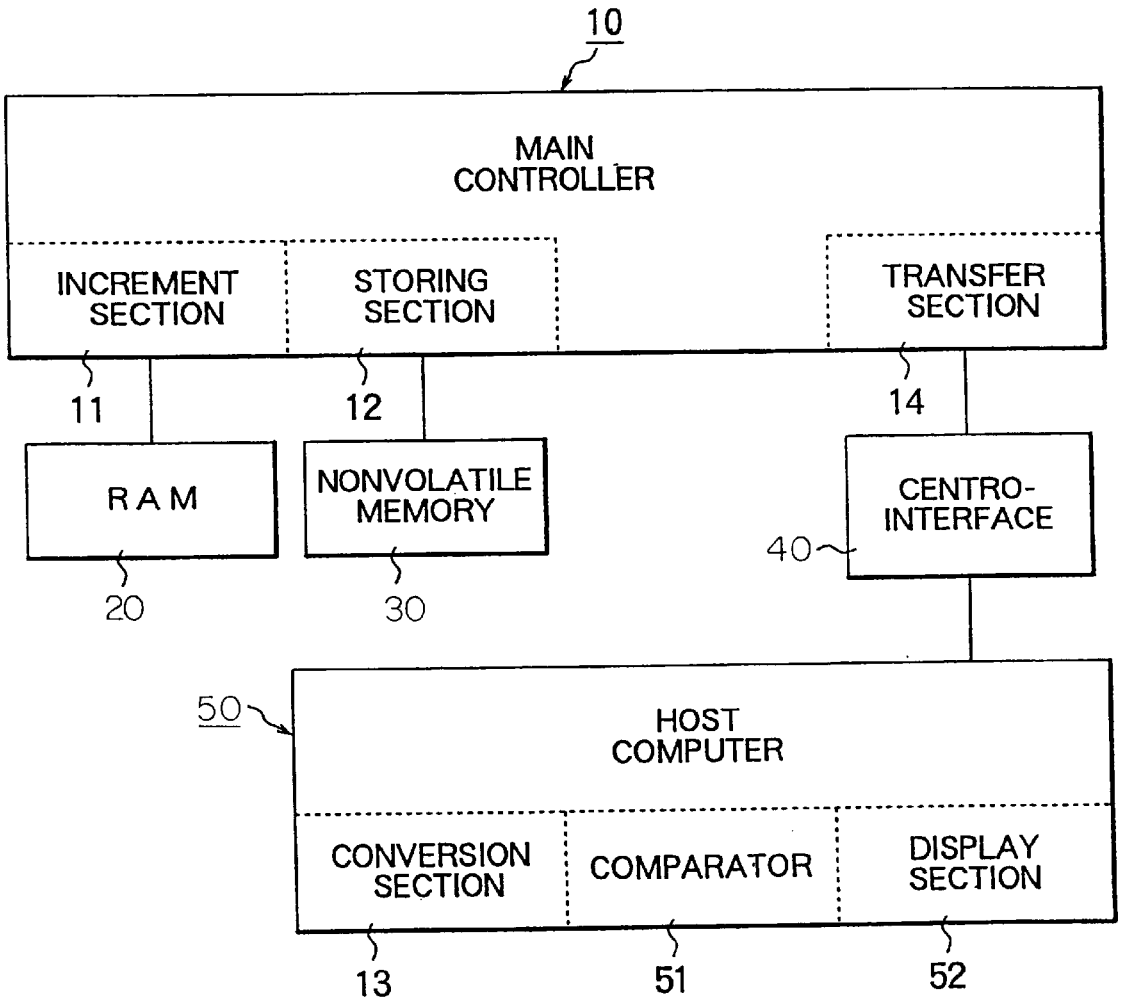
FIG. 10 is a block diagram of a system for detecting amount of ink consumption in an ink jet recording device according to a second embodiment of the present invention.

Referring to FIG. 10, a system for detecting amount of ink consumption in an ink jet recording device according to a second embodiment of the present invention is similar to the first embodiment except for the recorded amount conversion section 13 which is disposed in the host computer 50 in the present embodiment.

In the second embodiment, the read operation in the main controller 10 for reading the recorded amount from the non-volatile memory 30 does not include a recorded amount conversion step such as the step 33 shown in FIG. 3.

Figure 11:
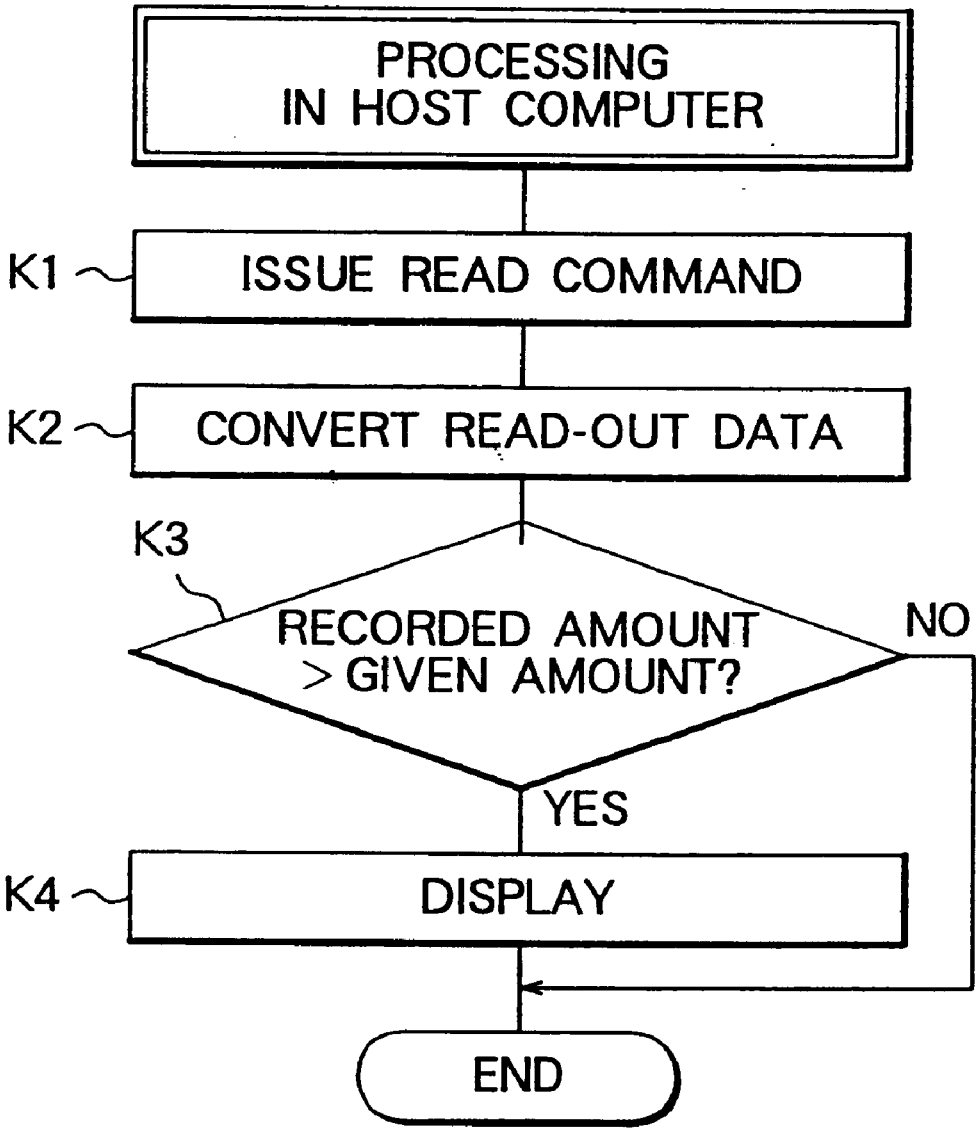
FIG. 11 is a flowchart showing the steps of operation of the system of FIG. 10.

Referring to FIG. 11 showing the steps of processing in the host computer 50 for reading the recorded amount, the host computer issues a read command for the recorded amounts or count for the respective operations at step K1. After the recorded amounts represented in terms of cleaning count, nozzle suction count and ink discharge count are received in the host computer 50, the recorded amount conversion section 13 in the host computer 50 converts the received counts into the respective recorded amounts, which are added together to obtain a total recorded amount at step K2. The comparator 51 then compares the total recorded amount against a given amount at step K3.

If the total recorded amount is higher than the given amount, the given amount is displayed as the recorded amount, or otherwise, may be displayed after conversion into a residual amount. On the other hand, if the recorded amount is less than the given amount, the process comes to an end without displaying the recorded amount because there is a plenty of residual amount of ink. Alternatively, the residual amount may be displayed similarly to the first embodiment as shown in FIG. 9 after adding a recorded amount conversion step between the step H1 for issue of the read command and the step H2 for the comparison.

Since the above embodiments are described only for examples, the present invention is not limited to the above embodiments and various modifications or alterations can be easily made therefrom by those skilled in the art without departing from the scope of the present invention.

What is claimed is:

1. A system for detecting an amount of ink consumption in an ink jet recording device, said system comprising:

a storage section for storing an accumulated recorded amount corresponding to an amount of ink consumption;

an increment section for counting numbers of times that predetermined ink discharge operations occur, the operations being cleaning of an ink nozzle, nozzle suction, and ink discharge;

a conversion section for converting said numbers of times into a corresponding amount of consumed ink, said corresponding amount of consumed ink being added to said accumulated recorded amount and stored as a new accumulated recorded amount;

a comparator for comparing said new accumulated recorded amount read from said storage section against a threshold amount to output a recorded amount signal; and a display section for displaying the recorded amount signal.

2. A system as claimed in claim 1, wherein said new recorded amount corresponds to a total amount of the ink consumption caused by cleaning of an ink nozzle, nozzle suction, and ink discharge.

3. A system as defined in claim 1, wherein said storage section and said increment section are disposed in said ink jet recording device and said comparator and said display section are disposed in a host computer.

4. A system as defined in claim 1, wherein said recorded amount signal represents either an accumulated ink consumption or a residual amount of ink.

5. A system as defined in claim 1, wherein said storage section is a non-volatile memory.

6. A system as claimed in claim 1, wherein said threshold amount is a variable amount.

7. A system for detecting the amount of ink consumption in an ink jet recording device that is capable of performing a plurality of types of ink consumption operations where each type of ink consumption operation has a corresponding amount of ink consumption, said system comprising:

a detection circuit for detecting any of said plurality of types of ink consumption operations;

a counter for counting each of said types of detected consumption operations;

a memory for storing a total number of consumption operations for each type of consumption operation counted by said counter;

a conversion circuit for converting the stored total number of consumption operations for each type of consumption operation into a total amount ink consumed by said device.

8. The system of claim 7 further comprising a comparator for comparing the total amount of ink consumed to a threshold amount.

9. A system according to claim 8, wherein said threshold amount is a variable amount.

10. The system of claim 7 further comprising a display for displaying said total amount of ink consumed.

11. The system of claim 7 further comprising a display for displaying an amount of ink remaining based on said total amount of ink consumed.

12. The system of claim 7 wherein said consumption operations include at least one of cleaning of an ink nozzle, nozzle suction, and ink discharge.

13. A method for determining an amount of ink consumption comprising the steps of:

performing a number of ink consumption operations from a plurality of types of ink consumption operations;

assigning a predetermined amount of ink consumption for each of the plurality of types of ink consumption operations;

determining for each performed ink consumption operation said type of ink consumption operation;

counting the number of times that each type of ink consumption operation is performed; and determining the amount of ink consumed based on a corresponding total count for each type of consumption operation.

14. The method of claim 13, further comprising the step of determining the amount of ink remaining.

15. A method as claimed in claim 14, further comprising a step of:

(a) comparing the amount of ink remaining against a given amount, (b) displaying the given amount as the amount of ink remaining if the amount of ink remaining is greater than the given amount, (c) lowering the given amount by a unit scale for the display if the amount of ink remaining is less than the given amount, (d) comparing the lowered given amount against the amount of ink remaining by repeating (a to c) until the amount of ink remaining becomes higher than the given amount, (e) displaying the amount of ink remaining when higher than the given amount according to (d).

16. The method of claim 13 wherein said consumption operations are at least one of cleaning of an ink nozzle, nozzle suction by the ink nozzle, and ink discharge.

* * * * *